US005313746A

United States Patent [19]

Zarriello

[11] Patent Number: 5,313,746

[45] Date of Patent: May 24, 1994

[54] TRIANGULAR SANDING APPLIANCE

[76] Inventor: Gerald E. Zarriello, 4814 Humboldt Ave. North, Minneapolis, Minn. 55430

[21] Appl. No.: 20,233

[22] Filed: Feb. 19, 1993

Related U.S. Application Data

[63] Continuation of Ser. No. 621,787, Dec. 4, 1990, abandoned, which is a continuation-in-part of Ser. No. 312,770, Feb. 17, 1989, abandoned.

[51] Int. Cl.[5] ..... B24D 17/00

[52] U.S. Cl. ..... 51/358; 51/389; 51/390; 51/391; 51/392

[58] Field of Search ..... 51/358, 378, 389, 391, 51/392

[56] References Cited

U.S. PATENT DOCUMENTS

| | | | |
|---|---|---|---|
| 1,501,192 | 7/1924 | Severns | 51/392 X |
| 1,520,642 | 12/1924 | Giroux | 51/393 X |
| 2,252,190 | 8/1941 | McAdams | 51/391 X |
| 2,417,356 | 3/1947 | Feild | 51/390 X |
| 2,729,925 | 1/1956 | Applegate | 51/392 X |

*Primary Examiner*—M. Rachuba

*Attorney, Agent, or Firm*—Nawrocki, Rooney & Sievertson

[57] ABSTRACT

A sanding appliance is described for supporting a sheet of sandpaper. The appliance includes a sanding pad with a flat lower sandpaper supporting surface of triangular outline. The pad is formed from sheet material which includes three edges defining the periphery of the sheet. The edges intersect at three points and a handle is connected to the pad for supporting and controlling the movement of the sander. The pad includes beveled surfaces at its edges which are inclined obliquely upward proceeding toward the center of the pad for supporting the edges of a sheet of sandpaper which are folded upwardly and centrally around the peripheral edges of the pad.

13 Claims, 3 Drawing Sheets

TRIANGULAR SANDING APPLIANCE

This is a file wrapper continuation of co-pending application Ser. No. 07/621,787 filed on Dec. 4, 1990, now abandoned, which is a continuation-in-part of application Ser. No. 07/312,770 filed on Feb. 17, 1989, now abandoned.

FIELD OF THE INVENTION

The present invention relates to appliances or tools and more particularly to a sanding appliance to be used for smoothing a surface.

BACKGROUND OF THE INVENTION

While the invention has a variety of applications, it is particularly useful in sanding drywall or sheetrock in building construction to prepare the surface for painting. The current drywall practice is to tape and finish the drywall with joint cement and then often to spray a textured finish on the ceiling. The resulting area spray and granular texture of the spray creates a painting and sanding problem for the painter. One objective of the invention is to provide a means for quickly and easily smoothing the joint between the wall and the ceiling to an easily painted surface at the ceiling line resulting in a smooth, professional appearance. When sanding is accomplished in the conventional way using a piece of folded sandpaper or a sanding block several deficiencies are encountered, including abrasion of the skin on the fingertips. Following a period of use, bleeding often occurs. Moreover, the sandpaper does not reach into the corner and does not provide a groove for the painter's brush. In addition, the sandpaper is difficult to hold and manipulate to achieve a professional appearance. This makes imperfections difficult to see until they are made noticeable by painting.

In view of these deficiencies it is an important objective of the invention to provide an improved sanding appliance that produces a smooth professional appearance and eliminates abrasion of the skin on the fingertips. It is also an objective to provide an improved sanding appliance which reaches into corners better and assist in providing a groove between the ceiling and wall for a painter's brush. It is another objective to make the sandpaper easy to hold and manipulate to achieve a professional appearance and to reliably sand or smooth the area between the ceiling and wall so that imperfections are more reliably removed as well as facilitating the sanding of inside and outside corners, i.e. intersection between walls. A further object is to provide a precisely finished edge between the texturized ceiling and a wall which permits painters to use a brush to "stripe a line" without getting texture material into the brush, thereby eliminating constant cleaning of the brush while painting. Yet another object is to provide an improved sanding appliance that is suited for use in a variety of applications including sheetrock tape sanding, use by painters, use in auto body finishing, furniture finishing, do-it-yourself applications and industrial or factory finishing.

These and other more detailed and specific objects of the invention will be apparent in view of the following specification which illustrates by way of example but a few of the various forms of the present invention that will be apparent to those skilled in the art within the scope of the appended claims.

SUMMARY OF THE INVENTION

The invention provides an improved sanding appliance for supporting a sheet of sandpaper. The appliance includes a sanding pad having a lower sandpaper supporting surface of triangular outline. The pad is formed from flat sheet material including three edges defining the periphery of the sheet. The edges are joined at three intersections. A handle is connected to the appliance for supporting and controlling the movement of the appliance.

THE FIGURES

DETAILED DESCRIPTION OF THE INVENTION

Figure 1:
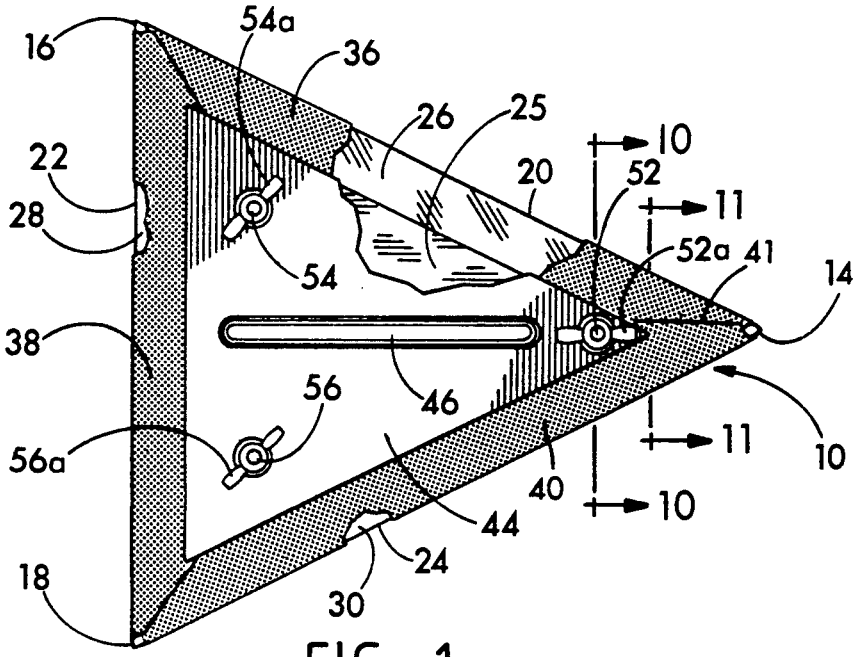
FIG. 1 is a plan view of the invention partly broken away.
Figure 2:
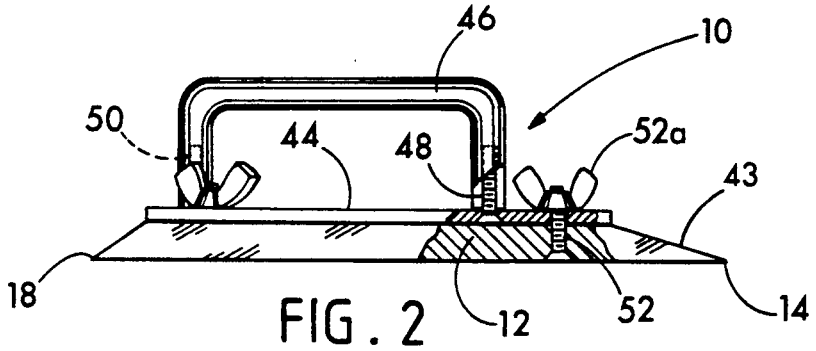
FIG. 2 is a side elevational view of the invention partly in section.

Shown in FIGS. 1 and 2 is a sanding appliance 10 that includes a sanding pad 12 of triangular outline as seen in plan view with three edges 20, 22 and 24 which intersect at points 14, 16 and 18. The intersection 14 can be 50 degrees and intersections 16 and 18 can each be 65 degrees to provide an isosceles triangle. The pad 12 can be formed from any suitable material of which a flexible plastic or firm rubber is preferred. The edges of the pad 12 are provided with beveled upper surfaces 26, 28 and 30 which are inclined obliquely in an upward direction proceeding from the peripheral edges 20, 22, 24 toward the center of the pad. The beveled surfaces provide a support against which centrally folded edges 36, 38 and 40 of a triangular sheet of sandpaper are placed. The beveled edges present a sharp edge over which the sandpaper sheet is folded for more reliably sanding into the inside corners between two walls or a ceiling and wall. This helps to produce a smooth line or groove, if desired, between the intersecting surfaces. Once the sandpaper sheet is mounted in this manner with the edge portions 36, 38, 40 folded upwardly and directed centrally into contact with the beveled surfaces 26, 28, 30, a handle support plate 44 is mounted on the upper surface of the pad 12 and is secured in place by fasteners including upwardly directed screws 52, 54, 56 to which are secured wing nuts 52*a*, 54*a* and 56*a*. From the upper surface of the support plate 44 extends a U-shaped handle 46 that is held in place by means of screws 48 and 50 (FIG. 2). The upwardly folded and centrally extending edges of the sheet of sandpaper are held securely in place by the edges of the plate 44. The sanding appliance is now ready for use.

Figure 10:
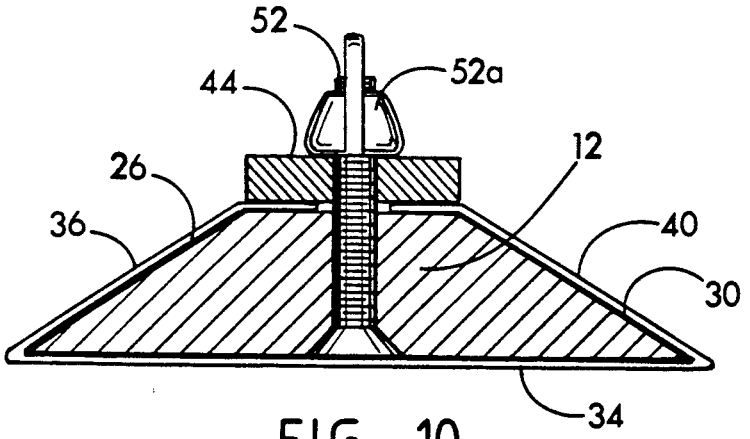
FIG. 10 is a vertical cross-sectional view taken on line 10—10 of FIG. 1.
Figure 11:
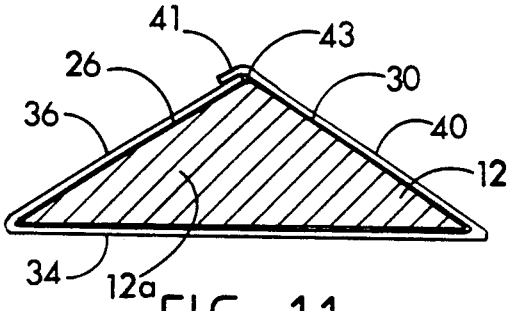
FIG. 11 is a vertical cross-sectional view taken on line 11—11 of FIG. 1.

The invention has other features which can be better understood by reference to FIGS. 10 and 11. As shown in these Figures, the central triangular portion 34 of the sandpaper sheet 32 contacts the bottom surface of the rubber sanding pad 12 with the flaps or tabs 36–40 folded upwardly and pressed against the beveled surfaces 26–30 of the pad 12. In FIG. 10 it can be seen that the free ends of the sandpaper tabs 36–40 are positioned to extend beneath the support plate 44 and are held securely in place their position between the plate 44 and the rubber pad 12. Accordingly, the invention provides a support or backing plate 44 of a rigid material with a handle 46. It can be seen in FIG. 10 that the beveled surfaces 26–30 at the edges of the pad 12 are inclined upwardly proceeding toward the center of the pad until they reach the side edges of the support plate 44, and it is at this point where they intersect the top surface of the pad 12 so that the edges of the sandpaper tabs 36–40 can extend between the backing plate 44 and the rubber pad 12 for securing the sandpaper sheet 32 in place.

FIG. 11 shows the unsupported diamond-shaped point 14 of the rubber pad 12. The diamond-shaped point shown in FIG. 11 has a flat bottom surface which contacts the center portion 34 of the sandpaper sheet 32 and two upwardly inclined centrally extending beveled surfaces 26, 30. These beveled surfaces 26 and 30 intersect the bottom surface of the pad 12 at acute angles. At the top they intersect one another along an inclined intersection line 43 which, as shown in FIG. 2, extends downwardly proceeding outwardly toward the point or tip 14 of the pad 12. The points 16 and 18 are similar and have the same cross-sectional shape as shown in FIG. 11.

Accordingly, the invention provides a diamond-shaped point at the intersection between each of the three edges of the pad 12 which define triangular extensions of the rubber pad 12. The sandpaper sheet 32 surrounds each of the diamond-shaped points 14–18 with the bottom portion of the sandpaper below the point and folded tabs 36–40 extending obliquely up the sides of the point to the line of intersection 43 at the top of the diamond-shaped point which defines an obtuse angle between the beveled walls 26, 30 of the point. The upper free edges 41 of the sandpaper are proximate to one another or overlap slightly as shown in FIG. 11, if desired, along inclined intersection line 43 of the side walls 26, 30 of the point 14.

The diamond-shaped points 14–18 of the rubber pad 12 cooperating with the triangular sheet of sandpaper and its tabs which extend upwardly around the point provide several unexpected results. The point of sandpaper is narrow so that it can extend into tight corners such as those between a wall and the ceiling of a stairway. In addition, the tabs 36–40 remain in place, even though the points 14, 16, 18 extend outwardly beyond the support plate 44. Additionally, as shown in FIG. 11, the tabs provide reinforcement for the otherwise unsupported point of sandpaper 34 beneath the diamond-shaped point of the pad 12, bracing it on each side to hold it in place effectively during use, even beyond the end of the support or backing plate 44. In addition, each point of the pad 12 where it extends beyond the end of the backing plate 44 is slightly resilient. This allows a certain amount of upward bending of the point when the handle is lifted, i.e., tipped forwardly, permitting spot-sanding by the application of more pressure at the point or by tipping the handle upwardly to allow contact with the wall near just one of the points. Under these conditions, the point and underlying sheet of sandpaper will bend slightly, allowing the user to control the size of the area being sanded by tipping the handle to a greater or lesser extend as the sanding operation continues.

Figure 12:
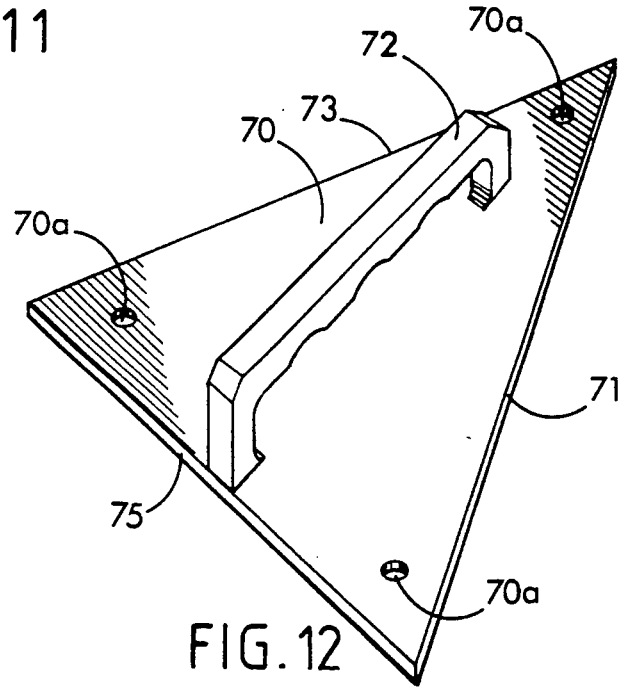
FIG. 12 is a perspective view of another form of support plate and handle in accordance with the invention.
Figure 13:
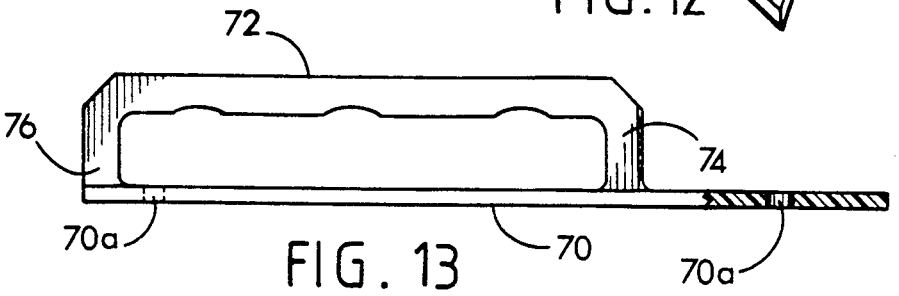
FIG. 13 is a side elevational view partly in section of the support plate of FIG. 12.

Refer now to FIGS. 12 and 13 which illustrate another form of backing plate and handle in accordance with the invention. In this case, the backing plate 70 and integral handle 72 are formed from plastic resin and are produced preferably by injection molding. The backing plate 70 is triangular in shape with three intersecting edges 71, 73, 75. The handle 72 includes a central horizontal section with legs 74, 76 which extend downwardly to the upper surface of the backing plate 70. To connect the backing plate to the elastic pad 12, suitable openings such as 70*a* can be provided for fasteners as described above. The operation of the backing plate 70 is the same as described in connection with backing plate 44.

Figure 3:
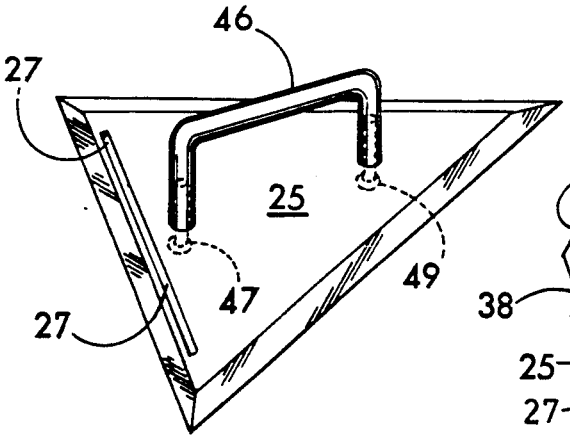
FIG. 3 is a perspective view of another form of the invention on a smaller scale.
Figure 4:
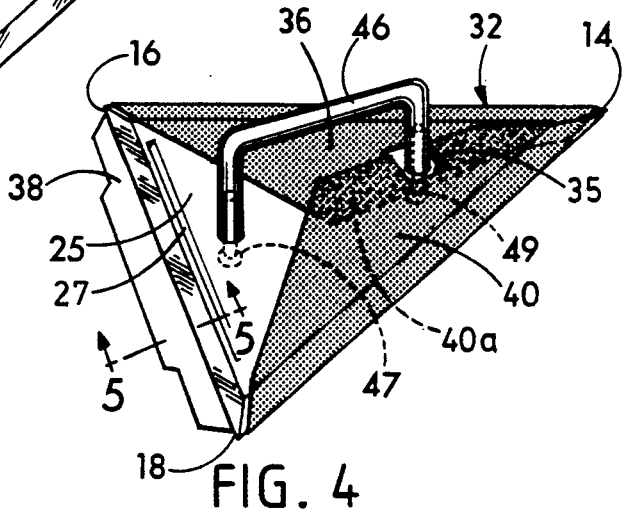
FIG. 4 is a perspective view of the appliance of FIG. 3 with sandpaper in the process of being mounted thereon.
Figure 5:
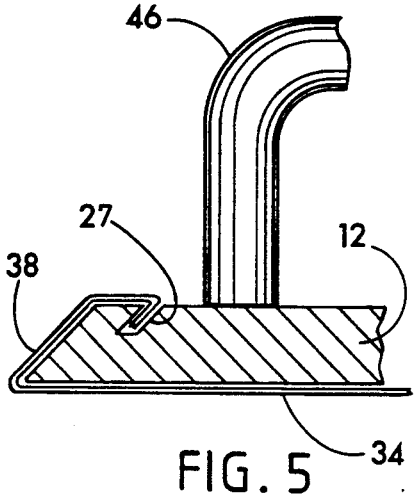
FIG. 5 is a vertical cross-sectional view taken on line 5—5 of FIG. 4.
Figure 8:
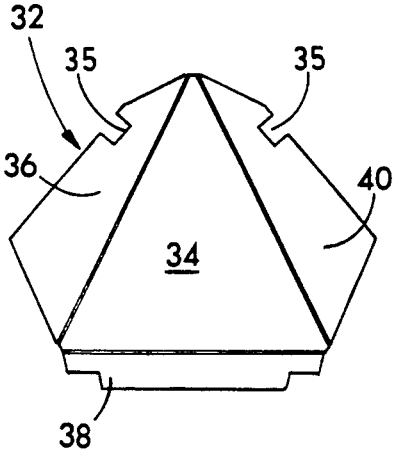
FIG. 8 is a plan view of one form of sandpaper sheet to be used in accordance with the invention.

In the form of the invention illustrated in FIGS. 3–5, the triangular pad is of the same general construction described above, but in this case the pad 25 is provided with a sandpaper tab receiving slot 27 for receiving a tab 38 provided on one edge of a specially prepared sandpaper sheet 32 (FIG. 8). In this case, the handle 46 is secured directly to the pad without the requirement for a plate 44 by means of screws 47, 49. The sandpaper sheet 32 is provided with side flaps 36, 40 having peripheral notches or cutouts 35 to accommodate the front portion of a handle 46. Sandpaper sheet 32 is provided with a triangular-shaped central portion 34 of the same dimensions as the pad 25 with fold lines along its edges corresponding to the edges of the pad 25.

During use the flaps 36 and 40 are folded upwardly and centrally and are bonded together by means of an adhesive 40*a* as shown in FIG. 4 which can be a pressure sensitive adhesive, if desired, applied to one or both mating surfaces of the sheet 32. Next, the tab or flap 38 is folded into the slot 27 as shown in FIG. 5 to secure the sheet 32 in place. The sanding appliance is now ready for use.

Figure 6:
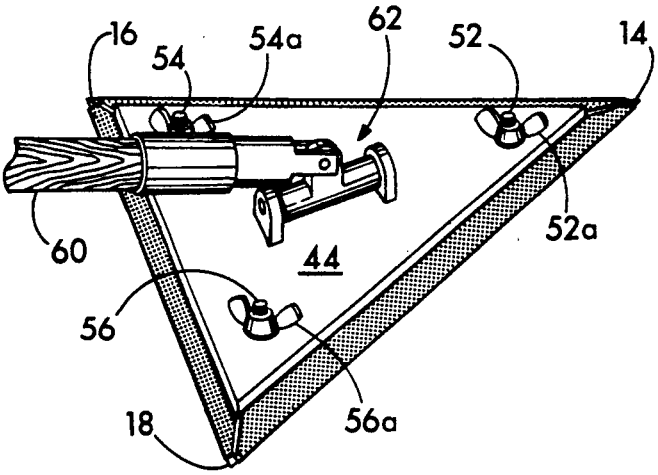
FIG. 6 is a perspective of another form of the invention.

Refer now to FIG. 6 which illustrates another form of the invention similar to FIGS. 1 and 2 and in which the same numerals refer to corresponding parts. In this case, however, a different kind of handle is provided. The handle in this case comprises a pole-type handle 60 similar to the handle of a hoe or broom. The handle 60 can be formed from wood and is secured to the sanding appliance by means of a universal joint 62. The pole handle 60 enables the appliance to be easily supported from a distance for sanding in high or difficult to reach places.

Figure 7:
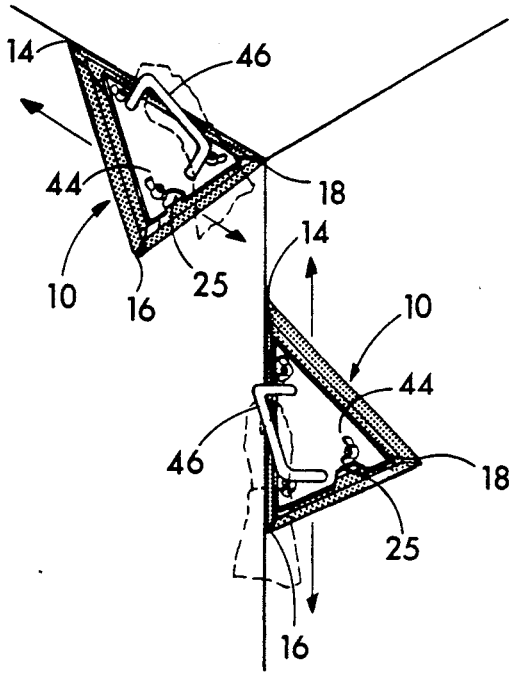
FIG. 7 is a perspective view showing the use of the invention in a corner between a ceiling and a wall and on an inside corner between two walls.

Refer now to FIG. 7 which illustrates how the invention is used in sanding on an inside corner at the lower right and shows the sanding appliance 10 being raised and lowered alternately in a vertical direction by means of a handle 46 against an inside corner. It will be seen that the point 14 of the sander will easily reach into the intersection between the two walls and the corner. At the upper right the sanding appliance 10 is shown being moved from left to right along an inside intersection between a ceiling and wall with the point 18 of the sander extending into the corner. Using the appliance in this manner will enable a precise professional line to be formed along an inside edge between two intersecting surfaces and all the way into the corner between two walls and the ceiling.

Figure 9:
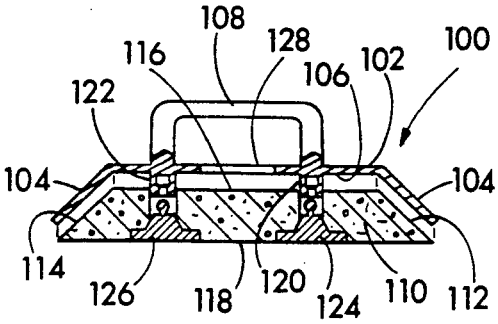
FIG. 9 is a vertical sectional view of another form of the invention.

Refer to FIG. 9 which illustrates another embodiment of the invention. Shown in FIG. 9 is a sanding appliance 100 having a handle support plate 102 and integral handle 108 and including oblique outwardly and downwardly inclined edge portions 104 (only two of which are shown). The support plate 102 includes an inside surface 106 which during use is placed adjacent to a sanding support pad 110. Both the handle support plate 102 and the pad 110 have a triangular shape similar to the other embodiments. The pad 110 includes upwardly and centrally inclined sandpaper support surfaces 112 and 114 as well as a third similar surface (not shown). The pad 110 includes an upper surface 116 that lies adjacent to the inner surface 106 of the handle support plate 102 and a lower surface 118 against which the sandpaper (not shown) is placed during use. The handle support plate 102 is connected to the pad 110 by means of releasable snap connectors 120 and 122 which releasably join the plate 102 to a pair of laterally spaced apart connecting lugs 124 and 126 that are fitted into recesses on the lower surface 118 of the sanding pad 110. To use the appliance of FIG. 9 a sheet of sandpaper of the same type shown in FIGS. 1, 2 and 5–7 of triangular outline is placed against the lower surface 118 of the pad 110 with edges folded upwardly and applied to the three beveled surfaces including the surfaces 112 and 114. With the sandpaper in place the plate 102 is forced downwardly until the connectors 120, 122 snap together to hold the appliance in an assembled condition. When the pad 110 is to be removed, the connectors 120, 122 can be unsnapped by applying pressure against the upper surface 116 of the pad through an opening 128. The sandpaper can then be replaced and the appliance reassembled.

Many variations of the present invention within the scope of the appended claims will be apparent to those skilled in the art once the principles described herein are understood.

What is claimed is:

1. An improved hand sanding appliance comprising, a sanding pad having a flat lower sandpaper supporting surface of triangular outline;

three linear edges defining the periphery of said pad, said three linear edges being joined at three intersections;

at least two upwardly facing beveled surfaces that are inclined at an oblique angle extending from each of the linear peripheral edges of the pad centrally thereof and intersecting the lower surface at an acute angle;

a sheet of sandpaper having a triangularly-shaped central portion with three linear edges corresponding to the linear edges of the pad and flaps at the linear edges of the sheet;

each of the flaps being folded with respect to the central portion along one edge of the central portion;

the beveled surfaces being distributed around at least two linear edges of the pad so as to provide an inclined support for each of said flaps during use and the beveled surfaces present a sharp linear edge over which the sandpaper is folded;

a handle connected to the appliance for supporting and controlling the movement of said appliance;

at least one point with a triangularly-shaped cross-section at the intersection between the linear edges of the pad, at least two points being less than 90° as seen in plan view;

each triangularly-shaped point providing an acute projection on the linear periphery of the pad;

each triangularly-shaped point being bounded on the sides by portions of the beveled surfaces, said portions of the beveled surfaces being inclined upwardly proceeding toward the center of the point;

the beveled surfaces intersect at the top of each triangularly-shaped point along an inclined line of intersection proceeding outwardly and downwardly toward a tip portion of the point and at an acute angle to the lower surface;

the sandpaper sheet includes a flat bottom portion contacting the bottom surface of the point and a pair of said flaps being folded upwardly and extending obliquely up the sides of the triangularly-shaped point and having upper free edges that are proximate to one another along said inclined line of intersection between the beveled surfaces, whereby the sandpaper flaps provide support and stability for the portion of the sheet below the point; and a rigid backing plate for supporting the pad, wherein the pad is constructed from a slightly resilient material having a flat upper surface, said backing plate being connected to said flat upper surface with the triangularly-shaped points and the linear edges extending unsupported outwardly beyond the rigid backing plate at least a distance equal to the beveled surfaces that are inclined at an oblique angle from each of the linear peripheral edges such that the elasticity of the points and linear edges permits the points and the linear edges to yield when the appliance is tilted with respect to a surface being sanded.

2. The hand sanding appliance of claim 1 wherein the upwardly folded flaps of the sandpaper extend upwardly and centrally on either side of the triangularly-shaped points and are proximate to one another along the inclined line of intersection between the beveled surfaces of the pad at the top of the triangularly-shaped point to provide structural support for a bottom portion of the sandpaper sheet conforming to the bottom of the triangularly-shaped point to brace the bottom portion and hold it in place during use.

3. The sanding appliance of claim 1 wherein said handle is connected to a support plate, said support plate has a lower surface, fastening means is provided for securing the plate to the pad with edge portions of said sandpaper interposed between the support plate and the pad to thereby retain said flap portions of the sandpaper sheet in place on the pad.

4. The sanding appliance of claim 3 wherein the fastening means comprises releasable snap connectors removably connected thereto to retain the plate in place on the pad.

5. The sanding appliance of claim 1 wherein the sanding appliance includes a handle support plate, said handle support plate has outwardly and downwardly inclined obliquely disposed peripheral edge portions for retaining edge portions of a triangular sheet of sandpaper in place at the periphery of said appliance.

6. The sanding appliance of claim 5 wherein snap connectors are provided between the handle support plate and the pad for securing the support plate and handle to the pad.

7. The sanding appliance of claim 1 wherein said pad includes at least one elongated slot on an upper surface thereof to receive a flap portion of the sheet of sandpaper to assist in holding said flap and said sandpaper sheet in place upon the pad.

8. The sanding appliance of claim 1 wherein the sanding pad has the shape of an isosceles triangle with two angles of about 65 degrees and one angle of about 50 degrees as seen in plan view.

9. The sanding appliance of claim 3 wherein said backing plate has an integral handle extending upwardly from an upper surface of said backing plate and said handle and backing plate are formed from a plastic resinous material.

10. A hand sanding appliance comprising, a pad formed from a body of a resilient material having a lower support surface and an upper surface, said pad having a triangular shape defined on the lower surface by three linear edges, a rigid backing plate connected to the upper surface of the pad for supporting the pad, a handle on the backing plate, said pad having at least one resilient point with linear side edges that intersect as seen from above at an acute angle, the pad is a resilient member having at least two beveled surfaces extending upwardly and centrally from the linear side edges of the point, said beveled surfaces intersecting the lower surface of the pad at an acute angle so that the beveled linear edges each present a sharp edge over which a sheet of sandpaper is folded during use, said point and beveled linear edges extending outwardly beyond the edge of the backing plate so as to provide a resilient point and resilient beveled linear edge of resilient material, unsupported by the backing plate, and said sheet of sandpaper providing abrasive material on at least the lower support surface of the resilient point, the elasticity of the pad allowing the point and beveled linear edge to yield when the rigid backing plate is tilted with respect to a surface being sanded thereby permitting greater sanding pressure to be applied in an area adjacent the point and beveled linear edge.

11. The appliance of claim 10 wherein the abrasive material comprises a sheet of sandpaper having portions wrapped around said resilient point.

12. The appliance of claim 10 wherein the pad has three edges that intersect at three such points.

13. The appliance of claim 10 wherein a sheet of sandpaper is applied to the lower surface of the pad and has flaps that are folded upwardly at the edges of the pad and thereby enclose said point, whereby the flaps on each side of each point brace the sandpaper below each point.

* * * * *